United States Patent [19]

Antonissen

[11] Patent Number: 4,572,044

[45] Date of Patent: Feb. 25, 1986

[54] METHOD AND APPARATUS FOR SLICING A PRODUCT IN ACCORDANCE WITH ITS ANTICIPATED WEIGHT DISTRIBUTION

[75] Inventor: Peter Antonissen, Norfolk, England

[73] Assignee: Thurne Engineering Company Limited, Norfolk, England

[21] Appl. No.: 614,427

[22] Filed: May 29, 1984

[30] Foreign Application Priority Data

May 27, 1983 [GB] United Kingdom ..... 8314762

[51] Int. Cl.[4] ..... B26D 7/06; B26D 7/27

[52] U.S. Cl. ..... 83/42; 83/71; 83/77; 83/88; 83/364; 83/367

[58] Field of Search ..... 83/69, 71, 73, 77, 81, 83/82, 88, 278, 360–364, 367, 370, 42; 364/475, 567, 568; 177/165; 318/646

[56] References Cited

U.S. PATENT DOCUMENTS 3,519,051 7/1970 Badgley et al. ..... 83/69 X 3,599,689 8/1971 Grant ..... 83/73 X 4,194,267 3/1980 Johnson et al. ..... 83/363 X

*Primary Examiner*—James M. Meister

*Attorney, Agent, or Firm*—Sughrue, Mion, Zinn, Macpeak & Seas

[57] ABSTRACT

A slicing machine for slicing a product, comprising a blade 1 and a feeding mechanism 8, 9, 11, 12, to feed the product towards the blade 1 also includes a programmed computer 18 to control the feed rate of the feeding mechanism 8, 9, 11, 12 and programmed with a function corresponding to the typical weight distribution of at least one type of product. The computer 18 is programmed to respond to the input of information representing the weight and length of a particular product to modify the typical weight distribution function in accordance with the input values to provide an anticipated weight distribution for that particular product. The computer is also programmed to control the operation of the feeding mechanism 8, 9, 11, 12, so that the product is fed towards the blade 1 at a rate which varies with the anticipated weight distribution.

9 Claims, 4 Drawing Figures gr/mm

BACK
BACON
MOULDED PRODUCT
(Tapered Mould)
RE-SHAPED HAM
SAUSAGES
(Plastic Skin)
WEIGHT/SLICE OF UNIFORM THICKNESS
LENGTH
mm

METHOD AND APPARATUS FOR SLICING A PRODUCT IN ACCORDANCE WITH ITS ANTICIPATED WEIGHT DISTRIBUTION

BACKGROUND OF THE INVENTION

This invention relates to slicing machines that are principally used for slicing food products, particularly slicing cheese, meat and pressed or moulded meat products.

Such a slicing machine comprises a rotating blade which either has a spiral cutting edge or has a circular cutting edge and is mounted for planetary motion, and means to feed the product towards the blade so that upon each revolution or each gyration of the blade, one slice is cut from the face of the product. The means to feed the product may be a continuous conveyor but usually the slicer includes a fixed platform on which the product is placed and a feeding head which engages the rear face of the product and which urges it towards the blade. The feeding head is moved by a hydraulic ram or by a leadscrew driven by a stepping or variable speed electric motor.

A slicing machine is usually required to produce groups of slices and each group is then packaged separately. This may be achieved by having the slicing machine discharge onto a constant speed conveyor and by interrupting the feed of the product towards the blade for a period of time, each time a predetermined number of slices have been cut from its face. However, more usually, a jump conveyor is located downstream from the blade of slicing machine. In this case the jump conveyor moves forward at a first speed whilst the slices that form each group are being cut and then, after the number of slices required for each group have been cut, the jump conveyor moves at a second speed which is considerably faster than the first speed, and then returns to the first speed for the slices to form the next group. In this way the slices are cut at a uniform rate from the product but the increase in speed of the jump conveyor after each group of slices has been cut, results in a series of groups of slices being formed on the jump conveyor.

It is desirable for each group of slices to have a predetermined, required, weight and various attempts and proposals have been made in the past for ways to achieve this. One way is for the product to be moved towards the blade at a constant speed so that the slicer always gives a particular required number of slices and these will be under the required weight, and then, upon subsequent weighing of each group of slices a portion of a single slice is added to the package by hand to make it up to the required weight. Firstly, this is very labour intensive and secondly it is undesirable from a commercial point of view because it is preferred that each pack contains only whole slices.

More recently, slicing machines have been made more sophisticated by the inclusion downstream of the slicing machine of means to weigh a group of slices cut by the slicing machine, and then, in dependence upon the weight of this preceding group, vary the speed of movement of the product towards the blade by a feedback system to ensure, as far as possible, that each slice has a particular, predetermined weight. This apparatus is very complicated and inevitably there is some time lag between the cutting of a group of slices and the determination that that group has been cut too thickly or too thinly, and then a further time lag before the feed of the product towards the blade is changed to make a correction. Most food products are natural in origin and therefore not uniform and accordingly it has been found that when the slice thickness is adjusted in this way it does not always produce the desired effect and may even increase the errors.

We have also proposed in our earlier patent specification GB-A No. 2099609 that some account can be taken of differences between pieces of meat or meat products by simply weighing the piece of meat or meat product and also measuring its length and then setting the feed rate of the product towards the blade to a uniform value in accordance with the average weight/unit length.

Whilst this technique produces surprisingly good results compared to the weight feedback systems, food products may not be of uniform density along their length. The density varies with such factors as the meat/fat ratio, with preferential liquid retention zones and surface dehydration and these factors naturally depend upon the source, the nature of the particular cut of the meat and the processes used in the pretreatment of the meat or other product including refrigeration cycles and any pressing that has taken place. In addition to these variations in density, variations also occur in the overall shape and hence cross-sectional area of some products particularly meat or meat product. Changes in the cross-sectional area naturally affect the weight of slices of a particular thickness of that are cut. In spite of these great differences that occur in such naturally produced materials we have discovered that, for example, products of a particular type such as sides of back bacon all have a roughly similar weight distribution along their length. Naturally the physical cross-sectional area of individual sides of bacon vary, as does their weight and overall length, but in all these cases, the weight distribution profile of sides of bacon have the same general form and for back bacon it has a form somewhat resembling a sinusoidal curve. For moulded meat products, such as those formed in a vertical tapered mould the typical weight distribution profile is a square law curve.

SUMMARY OF THE INVENTION

According to this invention we make use of this discovery by weighing a non-uniform product, measuring its overall length, and using these measurements with a weight distribution function for that type of product, to establish an anticipated weight distribution for that product, and then control the feed rate of the product through a slicing machine in dependence upon its anticipated weight distribution.

According to another aspect of this invention a slicing machine comprising a blade and feed means to feed a product towards the blade also includes a programmed computer to control the feed rate of the feed means and programmed with a function corresponding to the typical weight distribution of at least one type of product and programmed to respond to the input of information representing the weight and length of a particular product to modify the typical weight distribution function in accordance with the input values to provide an anticipated weight distribution for that particular product, the computer then being programmed to control the operation of the feed means so that the product is fed towards the blade at a rate which varies with the anticipated weight distribution.

Typically it is preferred that the slicing machine is arranged to group the slices into groups each containing a predetermined number of slices and in general, particularly when the weight distribution of the product is reasonably uniform, the only change that needs to be made during the feeding of the particular piece of product towards the blade is a change in the rate of feeding to change the thickness of the resulting slices. However, when there is a wider variation in the weight distribution along the length of product it is desirable to vary both the number of slices in each pack and the thickness of the individual slices, thereby to obtain the required optimum thickness and optimum number of slices in each group for a particular product or a particular portion of a particular product.

To achieve this, preferably the slicing machine is also constructed in accordance with our co-pending patent application Ser. No. 614,429 filed on the same date and claiming priority from earlier British patent application No. 8314765. In this case, the information corresponding to the calculated anticipated weight distribution along the particular product is used as the information on the weight of the product per unit length and then this information is used to control the same or an additional programmed computer in the way set out in our co-pending application to produce the optimum number of slices in each group and to ensure that they are of the optimum thickness to produce groups of the required weight.

The weight and the length of a product may be measured manually and then the results input manually into the programmed computer. However, it is very much preferred that the slicing machine also includes means to weigh the product and produce an electrical signal corresponding to the weight of the product and means to measure its length.

The means to weigh the product and produce an electrical signal preferably includes a platten on which the product is placed, and which bears on a load cell having an output in the form of an analogue electrical signal. Naturally an appropriate interface such as a digital to analogue converter is included to convert the signal into digital form so that it can be more easily handled by the computer. The platten preferably also includes an abutment and has associated with it the means responsive to the length of the product. This means may be formed a caliper arm which is movable along the platten and which is coupled to a potentiometer. In this way a product is placed on the platten with an end against the abutment and the caliper arm is moved along the platten until it engages the other end of the product. At this point the resistance of the potentiometer has a particular value which is indicative of the length of the product. Conventionally the potentiometer is set up as a potential divider so that its output is in the form of an analogue voltage signal, the voltage of which varies with the length of the product. Again, such an analogue signal is converted into digital form before being processed by the computer. Alternatively, the means responsive to the length of the meat or meat product includes an ultrasonic distance measuring device and, in this case, this is set up adjacent the end of the platten remote from the fixed abutment. The product is placed on the platten with one end against the fixed abutment and then the ultrasonic distance measuring device measures the distance between itself and the other end of the product. The ultrasonic distance measuring device may also subtract this distance from the known distance between the fixed abutment and the device to produce the length signal indicative of the length of the product. Alternatively, this calculation may also be performed by the programmed computer.

The means responsive to the length of the product may include an elongate array of photoelectric devices and an indication of the length of the product be given by identifying the number of photoelectric devices which are obscured by the product.

The feed means preferably includes a feeding head which engages the rear face of the meat or meat product and urges this towards the blade of the slicer. The feeding head may be moved substantially continuously or, alternatively, may be arranged to move stepwise in between each revolution or gyration of the blade. This method of operation is particularly preferred where thicker slices are to be cut and where the product is for example corned beef. In general, when thinner slices are to be cut, for example when the meat to be cut is ham, it is preferred that the meat or meat product is moved continuously by the feeding means.

BRIEF DESCRIPTION OF THE DRAWINGS

Two slicing machines for slicing meat and meat products in accordance with this invention will now be described with reference to the accompanying drawings; in which.

DESCRIPTION OF PARTICULAR EXAMPLES

Figure 1:
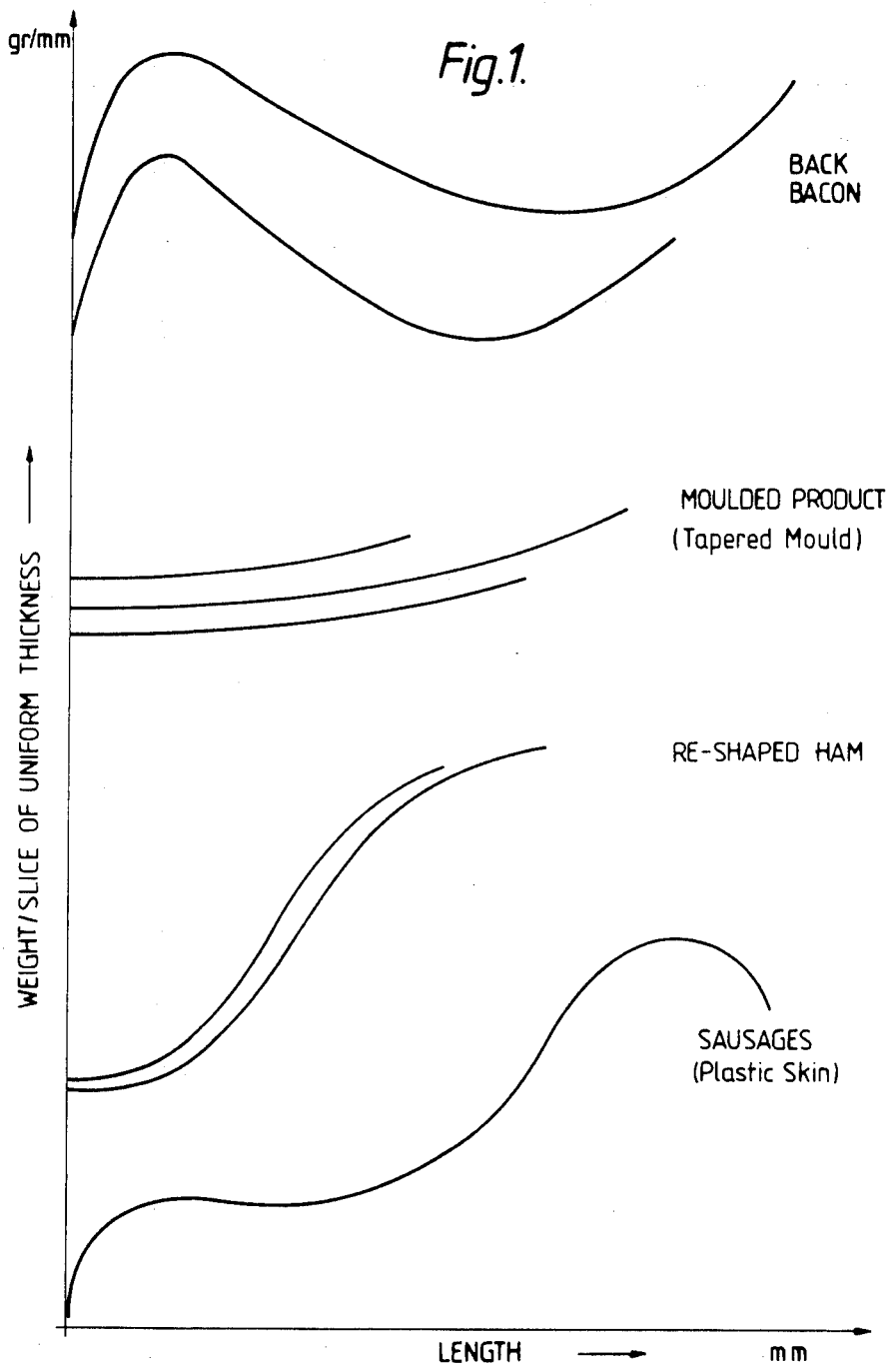
FIG. 1 shows a series of curves illustrating how the weight of a slice of meat varies along the length of that piece of meat.

FIG. 1 shows how the weight of individual slices of uniform thickness vary along the length of a piece of meat or meat product. FIG. 1 shows that the weight distribution for bacon is approximately a sinusoidal distribution whereas the distribution for moulded products using a vertical tapering mould filled to different extents is generally a square law curve. Re-shaped ham which is ham that after having the bone removed has been pressed, has a generally S-shaped weight distribution curve and sausages with a plastic skin that have been suspended so that the sausages themselves are somewhat pear-shaped have the exaggerated pear-shaped curve shown at the bottom of the set of curves. We have found that virtually all products of the same general type have the same shape of curve but naturally the scaling of the curve along both the X and Y axes varies with the weight and length of the meat or meat product.

Figure 2:
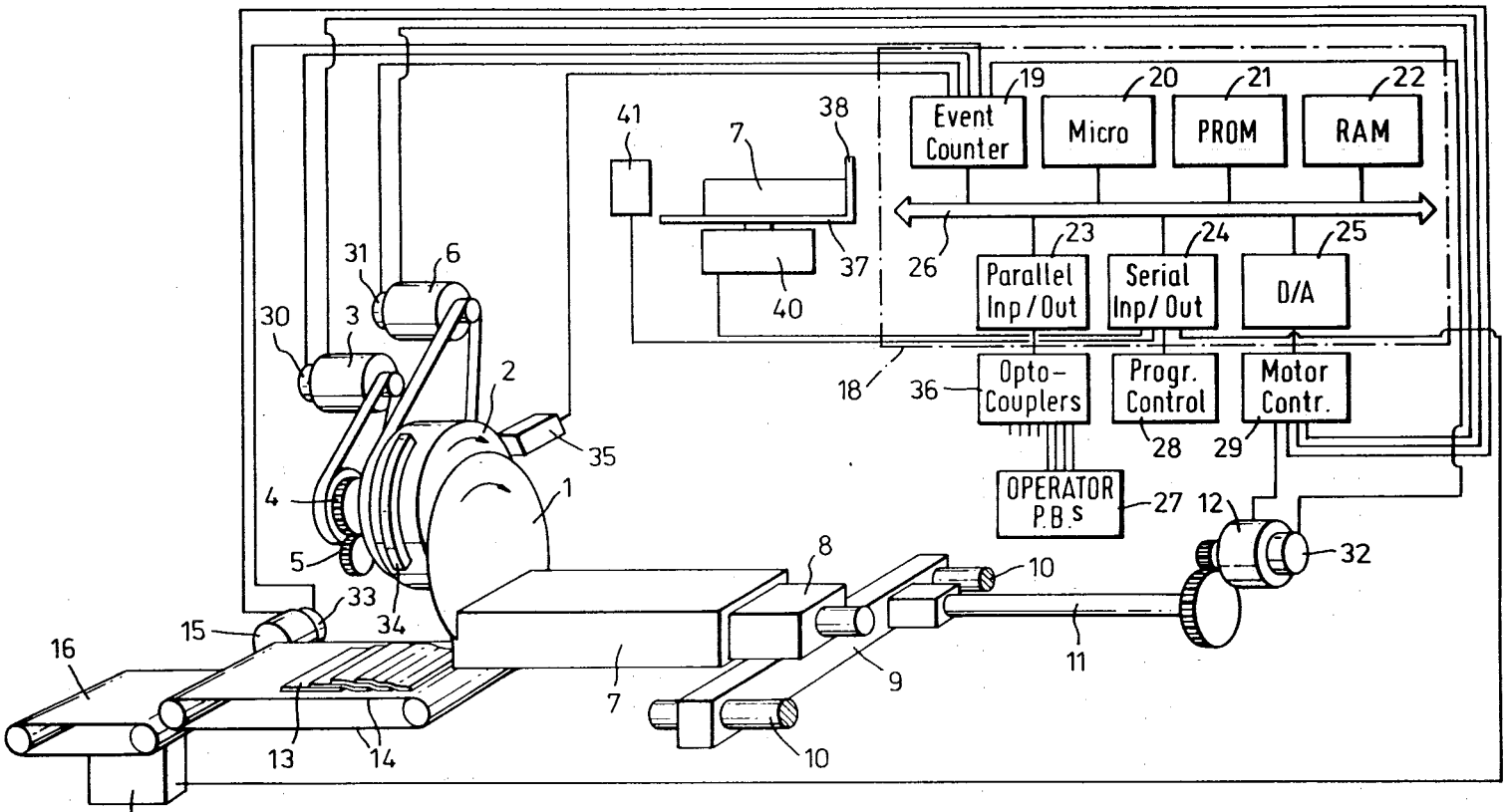
FIG. 2 is a diagrammatic representation of a first example.
Figure 3:
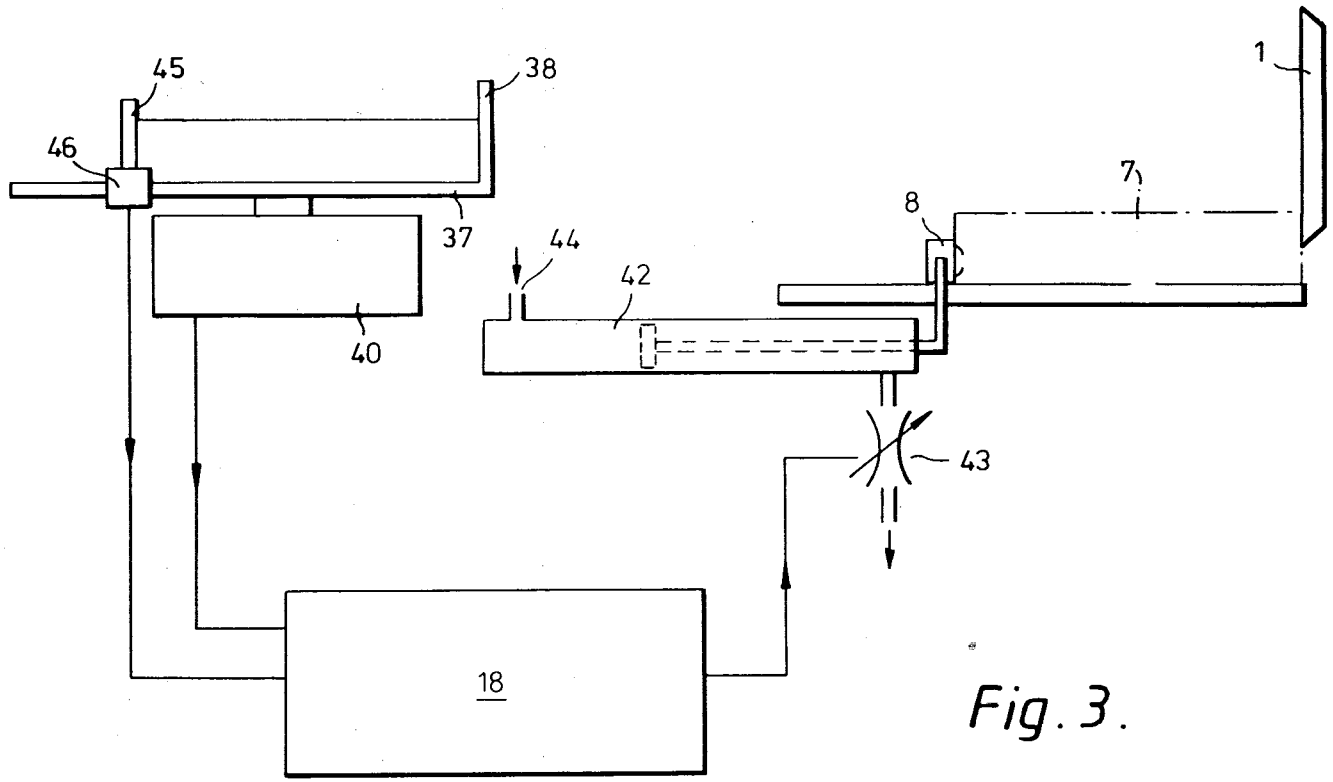
FIG. 3 is a further simplified diagram of a second example.

The basic mechanical construction of the first example of slicing machine and jump conveyor is conventional and is typically like that known as a "Polyslicer" manufactured by Thurne Engineering Co. Ltd of Norwich, United Kingdom. It comprises a planetary blade 1, journalled in a counter-rotating hub 2. The blade 1 is driven by a motor 3 through pinion gears 4 and 5 and the hub 2 is driven by a motor 6. A block 7 of meat or a meat product is placed on a feed table (not shown) and driven towards the blade 1 by feeding head 8. The feeding head 8 is mounted on a bearer 9 which is carried on a pair of rails 10. The feeding head 8 and bearer 9 are moved backwards and forwards along the rails 10 by a lead screw 11 which is rotated by a motor 12. Slices 13 of meat or meat product cut from the block 7 fall onto a jump conveyor 14 located downstream of the blade and driven by a motor 15. Downstream from the jump conveyor 14 is a conveyor 16 passing over a weigh cell 17. Slices 13 are cut from the face of the block 7 of meat by the blade 1 at a uniform rate. The jump conveyor 14 is moved forward continuously by the motor 15 at a first rate to provide a shingled group of slices as shown in FIG. 2 and then, after completion of the number of slices to form that group, the jump conveyor 14 is moved at a second, much faster rate by the motor 15, to provide a space between the last slice of one group and the first slice 13 of the next group. The groups of slices 13 are then fed from the jump conveyor 14 onto the conveyor 16 and as they pass over the weigh cell 17 their weight is monitored.

Whilst the mechanical arrangement of the slicer is generally conventional, the slicer also includes a computer 18. The computer 18 may be based on type RT1-1260/1262 manufactured by Prolog Corporation of the U.S.A., for example. The computer 18 typically includes an event counter 19, a microprocessor 20, a programmable read only memory 21, a random access memory 22, parallel input/output ports 23 serial input-/output ports 24, and digital to analogue convertor unit 25 all connected together by a bus 26. The computer 18 is also connected to operator control buttons 27, program control 28 and a motor controller 29. The motor controller 29 controls the operation of the motors 3, 6, 12 and 15 and these include encoders 30, 31, 32 and 33, respectively the outputs of which are fed into the computer 18. The hub 2 includes a cam 34 which cooperates with a proximity switch 35 to provide an output representative of the position of the hub 2 and hence of the blade 1 around its orbit. FIG. 2 shows the encoders 30, 31, 32 and 33, and the proximity switch 35 being directly linked to the event counter 19 for simplicity, in practice these are coupled through an opto-coupling unit 36 and the ports 23. The computer 18 controls the operation of the motors 3, 6, 12 and 15, and hence control the peripheral speed of the blade 1, the rate of rotation of the hub 2 and hence the rate at which the slices 13 are cut from the block 7, the rate of movement of the block 7 towards the blade 1 and hence the thickness t of each slice 13, and also controls the operation of the jump conveyor 14 and hence the number of slices in each group. The computer also controls the timing of the actuation of the motor 12 and hence enables the machine to operate by moving the block of meat 7 only when the switch 35 indicates that the blade 1 is away from the block 7.

The slicing machine also includes a platten 37 including an abutment 38 at one end mounted on a load cell 40. An ultrasonic distance detector 41, such as that manufactured by Sonic Tape Ltd. of Great Britain is mounted adjacent the other end of the platten 37. Before being placed on the feed table of the slicing machine the block 7 of meat or meat product is placed on the platten 37 with one end against the abutment 38. The ultrasonic distance detector 41 transmits pulses of ultrasonic sound which are reflected from the other end of the block 7 of meat or meat product and returned to the ultrasonic distance detector 41. The ultrasonic distance detector 41 thus measures the distance between itself and the other end of the block 7 of meat or meat product. However, the distance detector 41 includes internal circuitry which enables this measured distance to be subtracted from a preset distance which is set up to correspond to the distance between the detector 41 and the abutment 38. The output from the distance detector 41 is thus a signal indicative of the length of the block 7 of meat product. The load cell 40 gives a signal representing the weight of the block 7 of meat or meat product. This information is fed to the programmed computer 18. The signals may be converted to digital form by the digital to analogue convertor 25.

The programmable read only memory 21 is programmed with the typical weight distribution functions for the entire range of products that are normally to be handled by the slicing machine. The operator transfers the block 7 from the platten 37 to the feed table of the slicing machine and using one or more of the push buttons 27 enters information into the computer 18 on the nature of the product to be sliced. Each product has its own weight distribution function and it also has its own typical slicing parameters such as the required weight of each slice, the speed at which it is to be sliced, and whether the block 7 is to be moved continuously whilst slicing occurs or whether the block is to be moved stepwise whilst the blade 1 is out of contact with the block 7. In addition the parameters may include the number of slices to be included in each group, the pitch of the shingle in each group, the spacing of adjacent groups on the jump conveyor 14 and so on. Usually the memory 21 is programmed with all of this information and then, upon entry of the code for the product to be sliced this information is entered as the preset values for all of these parameters. Of course all of these pre-set values may be set up manually by the operator using the push buttons 27 or varied as required.

One parameter which is often varied is the orbiting speed of the hub 2 to vary the rate at which slices are produced by the slicing machine. The slicing machine is usually at the upstream end of a packaging line and in the event of difficulties it is often required to slow down the rate at which the slices are formed. Preferably the computer 18 is arranged to control all the parameters above in an interactive manner so that, in response to say, reducing, the speed of the motor 6 driving the hub 2 the computer also reduces the speed of the motor 3 to maintain the same ratio between the speed of the rotation and gyration; reduce the feed rate of the block 7 by reducing the speed of the motor 12; and reduce the speeds of the jump conveyor 14 by reducing the speed of the motor 15. The computer 18 controls all of these simply in response to the operator manually overriding one instruction namely the cutting rate.

With the information on the weight and length of the block 7 of meat supplied from the load cell 40 and detector 41, together with the known pattern of weight distribution for meat products of that type, the computer 18 generates an anticipated weight distribution function for that particular block 7 of meat and then controls the motor 12 in accordance with this anticipated weight distribution to provide slices of the correct weight. How the computer achieves this will now be described in more detail.

FIG. 1 shows that the weight per unit length of any given product tends towards a recognisable pattern. Taking ior example the moulded meat products that are moulded in a vertical square section mould tapered along its length with the mould being 100 mm square at its closed end and having a 1 in 30 taper along its sides and being filled to a depth of x mm. Assuming that the consistency of the meat is absolutely uniform and of density 1, the weight W is equal to $$W = \int \left(100 + \frac{x}{30}\right)^2 dx \quad (1)$$

$$= \left[100x + \frac{x2}{3} + \frac{x3}{2700}\right]_{x1}^{x2}$$

For a piece say 600 mm long $x_1 = 0$ and $x_2 = L = 600$ mm thus

W=7280 grammes.

Considering individual groups of slices which would be obtained from this block of meat the same equation can be used to derive the portion length appropriate to 500 gramme units. By substituting for x at the beginning of the block 49.2 mm gives the correct weight whereas at the end of the piece of meat 34.4 mm gives the correct weight. Thus, supposing a fixed number of slices per group and a fixed slice thickness is used not many of the resulting packs would have the correct weight. However, in accordance with this invention the microprocessor is programmed to calculate the slice thickness required throughout the slicing operation and hence vary the feed rate of the meat or meat product in accordance with its anticipated weight distribution.

Assume that a slice weight of 50 grammes is required, then in this case the programmed computer 18 has as inputs, the total weight W of the meat from the load cell 40, the total length L of the block of meat 7 from the ultrasonic detector 41, the desired slice weight w which is pre-programmed into the computer 18 or entered manually via the operator push buttons 27. Feeding this into the equations set out above, the initial estimate of slice thickness is:

$$t = L\frac{w}{W} = 60 \times \frac{50}{7280} = 4.12 \text{ mm.}$$

Now substituting t as equal to x in equation 1 w=41.2566 grammes.

Applying a first correction to slice thickness $$dt = \left(\frac{50 - 41.1566}{50}\right) \times 0.412 = 0.72 \text{ mm and}$$

thus the revised thickness t=4.12+0.72=4.84 mm.

Reintroducing t into the above equation w=48.4761 grammes and then applying a final correction $$dt = \left(\frac{50 - 48.4781}{50}\right) \times 4.84 = 0.15 \text{ mm}$$

thus t=4.84+0.15=4.998 mm.

Thus using this value of t, the resulting slice weight would be:

w=49.98 grammes, i.e. almost exactly the desired slice weight of 50 grammes per slice. Having derived the value t for the thickness of the next slice to be cut the computer 18 via the motor controller 29 drives the feed head 8 to provide a movement of the block 7 equal to t during the next orbit of the blade 1.

Figure 4:
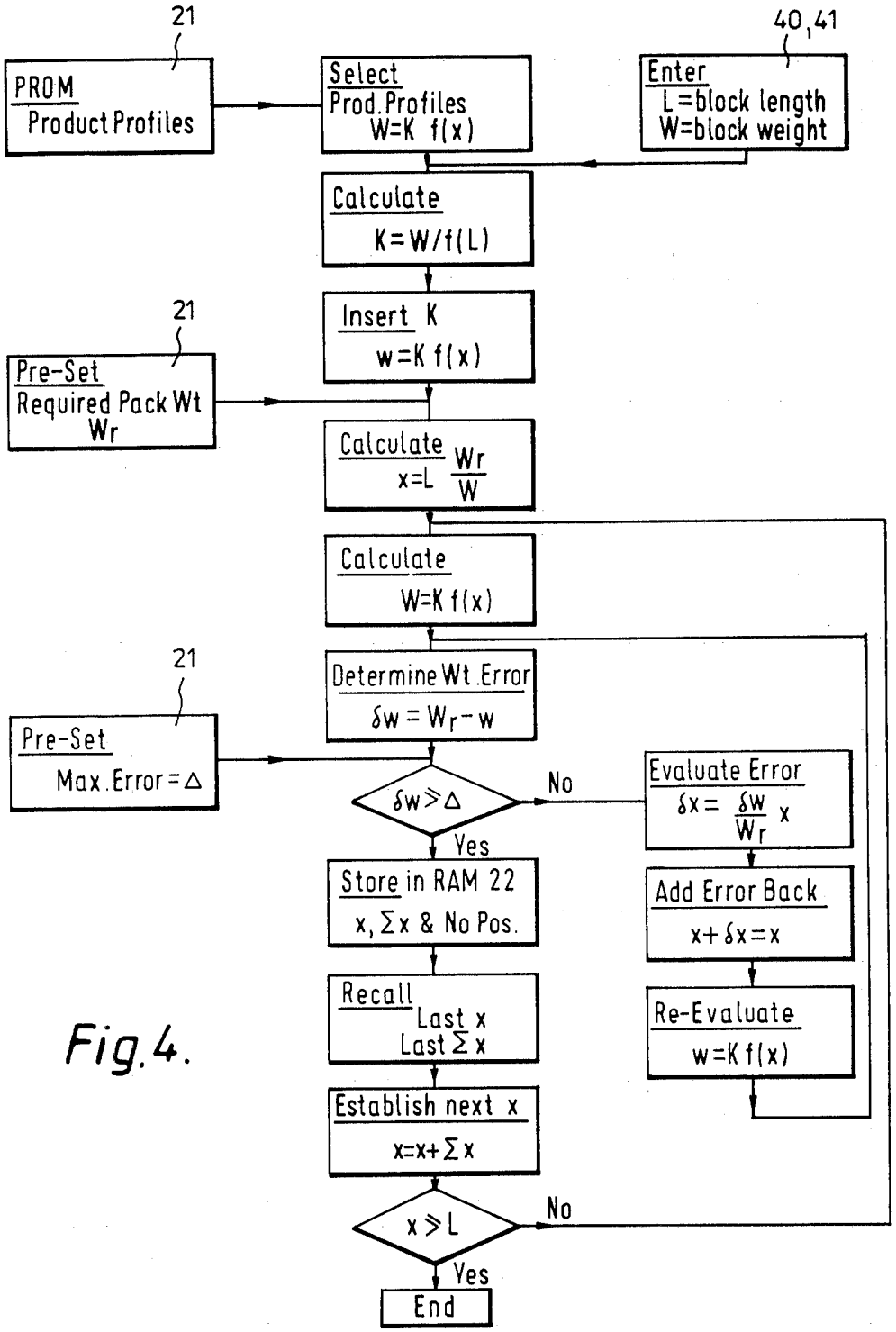
FIG. 4 is a flow diagram of a program loaded into the computer.

The computer 18 repeats this calculation and feed head 8 drive operation consecutively for 50, 100, 150 grammes, and so on throughout the slicing of the block of meat or meat product. The flow diagram of the program used by the computer 18 is shown in FIG. 4. Naturally, in practice meat does not have a density of 1 and constantly a correction factor is included in equation 1. For instance, with a meat density of 1.25, equation 1 becomes:

$$w_n = 1.25\left[100x + \frac{x}{3} + \frac{x}{2700}\right]_{x_{n-1}}^{x_n} \quad (2)$$

Taking another example in which an open moulded product is used which may be derived from moulds of different lengths and filled to different depths, the equation would be $$t = L\frac{w}{Wp}$$

where t=the desired thickness of the slice

L=the measured length of the piece of meat

W=the weight of the piece of meat and p=the average meat density

In this example, t would be constant and no subsequent adjustment would be required to the initial slice thickness. A further example where the meat is bacon may be represented by the summation of the following three equations:

I: a sin $\theta$ to correspond to the generally sinusoidal waveform of the product II: b $\theta$ to reflect the progressive rise towards the end of the piece of bacon III: c to represent the mean weight per unit length Thus as a good approximation the weight of the whole back may be represented by W, where $$\underline{W} = \int_{\theta 1}^{\theta 2} (a \sin\theta + b\theta + c)d\theta \quad (3)$$

$$= \left[a\cos\theta + \frac{b\theta}{2} + c\theta\right]_{\theta 1}^{\theta 2} \quad (4)$$

This is a general equation for back bacon which naturally needs to be modified in dependence upon the measured weight and measured length of an individual side of bacon. Again, if W is the measured weight and L the measured length then W=CW, $\theta$=DL and d$\theta$=DdL. Thus $$W = \frac{1}{C}\left[ a \cos DL + \frac{bD^2L^2}{2} + cDL \right]_O^L \quad (5)$$

From equations (3) and (5) the weight per unit length w can now be defined as follows $$w_n = \frac{1}{C}\left[ a \cos D_x + \frac{bD^2}{2} x^2 + cDx \right]_{xn-1}^{xn} \quad (6)$$

where w=the weight of the slice between x and x+1 x=the distance from the start of the back $x_n - x_{n-1}$=the increment measured for example in 0.01 mm a, b, c=pre-established constants, appropriate to back bacon D=a factor relating to the measured length of the back in connection with the calculation standard used in the microcomputer C=a factor relating to the observed weight of the back with reference to the calculation standard used in the microcomputer The side of bacon is weighed and measured using the load cell 40 and ultrasonic detector 41 and these values are entered into the computer 18. The computer 18 then calculates values of C and D using equation (5) and produces a look up table in the random access memory 22 to represent the anticipated weight to length profile of the side about to be sliced at desired intervals over its whole length. Typically this would take about one second. The slicing machine then commences and the computer 18 has also been loaded with or has as part of its program the required slice weight. The microprocessor 20 then examines the look up table looking for the required slice weight. Whilst this is being done the block 7 of meat or meat product is being moved towards the blade 1 whilst the cutting edge of the blade is remote from the block 7. When the microprocessor 20 has found the length corresponding to the desired slice weight, the position of the feed head 8 is matched to the thickness reading required and then as the blade 1 rotates or gyrates a slice is cut from the face of the meat product. The search in the memory 22 is then repeated until the weight of two slices is found in the look up table and the block 7 of meat or meat product is moved into a position to correspond to that of two slices. The next slice is then cut from the face of the meat or meat product. This process is repeated throughout the entire slicing operation on that side of bacon. Typically, the search through the look up table for the required distance along the piece of meat or meat product corresponding to the weight of the required number of slices takes about 1 to 2 milliseconds per slice to complete. As the slicer typically slices 1200 slices per minute the full slicing cycle for each slice takes about 50 milliseconds and thus there is ample time to compute the required location of the block 7 of meat or meat product and move it into this required location before each slicing operation.

The inclusion of the weigh cell 17 downstream from the slicing machine is not essential but such a weigh cell 17 can correct for deviations from the required weight of groups of slices. Since the programmed computer 18 is arranged to calculate the anticipated weight distribution of a particular side of meat the output from the weigh cell 17 which is analysed by the computer to provide a compensation signal for differences between the pack weight obtained and that required gives a correction which always improves the accuracy. In conventional machines including weigh cells the error signals may exaggerate the inaccuracies and lead to further errors. For example, consider the case of a conventional slicing machine including a weigh cell and cutting back bacon where the weight of the group of slices being weighed is calculated from a different part of the length from that subsequently being corrected. In this case it is clear that considerable additional errors are introduced by using a weigh cell. However, when the anticipated weight profile of the side of bacon has been calculated and is used to control the feed rate it is clear that the weigh cell downstream from the slicing machine can be used with advantage to make final corrections and to achieve an even greater proportion of correct weight packs.

The second example of slicing machine is a modification of an Anco slicer made by the Anco Corporation of United States of America. These slicers are well known as the standard slicer for the slicing of bacon. The slicer comprises a feed table and a rotating blade 1 having a spiral cutting edge. The blade rotates about a horizontal axis extending along and above the feed table. The side of bacon or other meat product 7 is placed on the feed table and its face remote from the blade 1 is engaged by a feed head 8. The feed head is driven by a hydraulic ram 42 to urge the side of bacon towards the blade 1. The thickness of the slices that are cut by the blade 1 thus depends upon the feed rate of the feed head 8. The feed rate is determined by a variable orifice throttle valve 43 connected to the outlet from the ram 42 which has a constant pressure hydraulic input 44.

To modify such a conventional slicer in accordance with this invention a platten 37 including an abutment 38 at one end is mounted on a load cell 40. The platten 37 has a caliper arm 45 mounted on it so that the caliper arm 45 can slide along the platten 37. The caliper arm 45 is coupled to a multi-turn potentiometer 46 through rack and pinion gearing (not shown). The slicing machine also includes a programmed computer 18 which is essentially the same as that described in the first example. The programmed computer 18 provides an output analogue control voltage from the digital to analogue convertor 25 which controls the variable orifice throttle valve 43 and in use adjusts the flow of hydraulic fluid through the throttle valve 43.

In use, an operator places a block 7 of meat or meat product on the platten 37 with one end against the abutment 38. The operator then manually moves the calpier arm 45 so that it abuts the other end of the block 7. The signal representing the weight of the meat is fed from the load cell 40 into the computer 18 and the multi-turn potentiometer 46 which is connected as a potential divider also transmits an electrical signal to the computer 18 which varies in dependence upon the length of the block 7. These analogue signals are converted into digital form. The second example operates in precisely the same way as the first example except, of course, the feed rate of the block 7 is controlled by controlling the throttle valve 43 instead of controlling the motor 12.

I claim:

1. A method of slicing a non-uniform product comprising weighing said product, measuring the overall length of said product, using said weight and length measurements in conjunction with a weight distribution function for products of that type to establish an anticipated weight distribution for that said product, and then controlling the feed rate of said product through a slicing machine in dependence upon said established anticipated weight distribution.

2. In a slicing machine for slicing a non-uniform product in accordance with its anticipated weight distribution including a rotatable slicing blade, and feed means to feed said non-uniform product towards said rotatable blade, the improvement wherein the machine also comprises a programmed computer arranged to control said feed means, and input means to input information relating to weight of said non-uniform product into said programmed computer, said programmed computer being programmed with a function corresponding to a non-linear weight distribution for at least one type of product and being programmed to respond to information input by said input means to modify said typical non-linear weight distribution function in accordance with said input information to derive an anticipated weight distribution for said product, said computer being programmed then to control operation of said feed means in accordance with said derived anticipated weight distribution for said product, whereby said product is fed towards said blade at a rate which varies with said derived anticipated weight distribution.

3. The slicing machine of claim 1, wherein said weighing means includes a platen on which said product is placed, and a load cell for producing said first electrical signal, said platen bearing on said load cell.

4. The slicing machine of claim 3, wherein said platen also includes an abutment, and wherein said length measuring means is associated with said platen.

5. The slicing machine of claim 4, wherein said length measuring means is formed by a caliper arm and a potentiometer, said caliper arm being movably mounted on said platen and movable with respect to said platen, movement of said arm along said platen effecting actuation of said potentiometer.

6. The slicing machine of claim 4, wherein said length measuring means includes an ultrasonic distance measuring device mounted adjacent an end of said platen remote from said abutment.

7. The slicing machine of claim 2, which also includes a jump conveyor, said jump conveyor being located downstream from said blade; operation of said jump conveyor to produce groups of slices also being controlled by said programmed computer.

8. The slicing machine of claim 7, further comprising a gyratory mechanism driving said rotatable blade, and wherein said computer also controls rotation and gyration of said blade, and, in response to a manual change in the speed of gyration to control the rate at which slices are cut, automatically resets the speed of rotation of said blade to maintain a predetermined ratio between its speeds of rotation and gyration.

9. The slicing machine of claim 2, wherein said input means comprises weighing means to weigh said product, to produce a first electrical signal representing its said weight and to input said first signal into said programmed computer, and length measuring means to measure the length of said product, to produce a second electrical signal representing its said length and to input said second signal into said programmed computer.

* * * * *